US006561592B1

(12) United States Patent
Guhr

(10) Patent No.: US 6,561,592 B1
(45) Date of Patent: May 13, 2003

(54) RUNNING WHEEL ARRANGEMENT

(75) Inventor: Wolfgang Guhr, Gründau (DE)

(73) Assignee: Litens Automotive GmbH, Gelnhausen (DE)

( * ) Notice: Subject to any disclaimer, the term of this patent is extended or adjusted under 35 U.S.C. 154(b) by 0 days.

(21) Appl. No.: 09/830,774

(22) PCT Filed: Nov. 10, 1999

(86) PCT No.: PCT/EP99/08609

§ 371 (c)(1),
(2), (4) Date: Jul. 11, 2001

(87) PCT Pub. No.: WO00/27490

PCT Pub. Date: May 18, 2000

(30) Foreign Application Priority Data

Nov. 10, 1998 (DE) ..... 198 51 825

(51) Int. Cl.[7] ..... A63C 17/22
(52) U.S. Cl. ..... 301/5.304; 152/47
(58) Field of Search ..... 301/5.301, 5.304, 301/5.307, 5.309; 152/17, 40, 47, 48, 50; 280/11.23, 11.22

(56) References Cited

U.S. PATENT DOCUMENTS 1,566,609 A * 12/1925 Larsen
1,651,009 A * 11/1927 White
1,679,819 A * 8/1928 Fageol
2,463,226 A * 3/1949 Walden
2,476,835 A * 7/1949 Cholet
3,389,922 A 6/1968 Eastin
4,035,026 A * 7/1977 Replin
5,069,462 A 12/1991 Murga ..... 280/23.1
5,199,727 A 4/1993 Lai
5,393,078 A 2/1995 Bourdeau
5,560,685 A * 10/1996 De Bortoli
5,716,060 A * 2/1998 Szendel
6,142,578 A * 11/2000 Pawlowski et al.

FOREIGN PATENT DOCUMENTS

WO WO 00/27490 5/2000

* cited by examiner

*Primary Examiner*—Russell D. Stormer
(74) *Attorney, Agent, or Firm*—Pillsbury Winthrop LLP

(57) ABSTRACT

The present invention relates to a running wheel arrangement having a hub and a running wheel, which is rotatably supported on the hub. Furthermore, the hub includes an internal hub and an external hub which are provided substantially in a manner fixed for co-rotation and which are displaceable against each other in the radial direction. The running wheel further includes a spring which is provided between the internal hub and the external hub.

17 Claims, 2 Drawing Sheets

RUNNING WHEEL ARRANGEMENT

This application is the National Phase of International Application PCT/EP99/08609 filed Nov. 10, 1999 which designated the U.S. and that International Application was not published under PCT Article 21(2) in English.

FIELD OF THE INVENTION

The present invention relates to a running wheel arrangement having a hub means and a running wheel rotatably supported on the hub means.

SUMMARY OF RELATED ART

Running wheel arrangements of this type are used in sporting devices such as inline skates. Running wheel arrangements of this type consist, in particular, of a wheel body made of polyurethane, and a rim fixedly connected to this wheel body. The rim in turn, is rotatably supported on a hub. The hub is finally attached by means of a shaft at a support provided at the inline skates.

A disadvantage of this known wheel arrangement is, however, that shocks on a single wheel of the inline skates cannot be absorbed but are rather transferred onto the inline skate. Shocks of this type reduce the driving comfort and also lead to a significant load on the joints.

Furthermore, the known wheel arrangement is susceptible to vibrations particularly at high running speeds.

SUMMARY OF THE DISCLOSURE

In view of the above-mentioned facts, the object of the invention is to improve the known wheel arrangements.

This object is solved by a wheel arrangement of the above-mentioned type, which is characterized in that the hub means has an internal hub and an external hub, which are provided in a manner fixed for co-rotation with one another and that they are provided displaceable with respect to each other in the radial direction and that it comprises a spring means which is provided between the internal hub and the external hub.

Since the hub means according to the invention comprises an internal hub, which can be connected to the inline skate by means of an axis, and an external hub which is provided in a manner fixed for co-rotation with respect to the internal hub and is movable with respect to the internal hub in the radial direction, the wheel arrangement may move substantially perpendicularly with respect to the inline skate. The spring means which is provided between the internal hub and the external hub can absorb shocks against the individual wheel arrangements of the inline skate in the direction of movement of the wheel arrangement with respect to the inline skate. Thus, the driving comfort is increased and at the same time, the joints of the inline skater are protected.

Moreover, vibrations of the wheel arrangement are reduced particularly at high speed.

According to an advantageous development of the invention, the external hub may be provided in the radial direction in a sliding movable manner within the interior hub. This avoids a possible tilting in case of obliquely acting forces, when driving with inline skates.

In another advantageous development of the invention, the axes of the external hub, i.e. the axis of rotation of the running wheel, and the attachment hub of the internal hub may be parallel and offset with respect to one another.

Hereby it is possible to mount the entire wheel arrangement in a downwardly offset manner with respect to the attachment axis. Thus, a conventional wheel arrangement, in which no space for a spring means is provided in the direction towards the inline skate, can be replaced by the wheel arrangement according to the invention.

Moreover, a higher spring path can be achieved by this arrangement while the size of the wheel arrangement is unchanged.

According to a further advantageous embodiment, the spring means may be formed in the form of an elastic body, preferably made of PU foam. Such a spring means is very simple to manufacture, and leads to an inexpensive realization of the wheel arrangement. By a suitable choice of the material, the shock-absorbing behavior can also be adjusted. Thus, it is possible to optimally adapt the wheel arrangement to respective driving situations, e.g. to a road or open country, and to the body weight of the inline skater.

The elastic body may comprise an opening, i.e. it may be formed in an annular manner. Then, it is possible to provide the internal hub with a section for the interlocking engagement into the opening of the elastic body, and to provide the external hub with a section for the interlocking accommodation of the elastic body. For this purpose, both sections are purposefully designed in a manner that the arrangement of the internal hub, which is substantially fixed for co-rotation with respect to the external hub, is ensured.

As an alternative, the external hub may comprise a section for the interlocking engagement into the opening of the elastic body, and the internal hub may have a section for the interlocking accommodation of the elastic body, wherein both sections are formed in a manner that the arrangement of the internal hub which is substantially fixed for co-rotation with respect to the external hub is ensured by the elastic body inserted.

Both alternatives also enable a very simple and therefore inexpensive realization of the wheel arrangement according to the invention. Moreover, this simple arrangement is characterized by its ruggedness and resistance to wear.

Moreover, the spring characteristics of the wheel arrangement, in particular the spring strength and the spring path can be adjusted and therefore adapted to the respective situation by the shape of the opening in the spring element and the shape of the corresponding engagement section.

According to a development of the above-described arrangements, the internal hub may have two halves which are extendable within one another in the axial direction such that they are arranged in a manner fixed for co-rotation. The halves may for instance comprise claws for forming a fixed coupling of the two halves. In an advantageous manner, the external hub may also comprise two halves. Furthermore, the spring means may comprise a first spring element and a second spring element, wherein the first spring element is provided between a half of the internal hub and a half of the external hub, and the second spring element is provided between the other half of the internal hub and the other half of the external hub.

This symmetric arrangement leads to a regular distribution of power into the axle of the inline skates. This finally leads to the fact that the wheel arrangement of the inline skates is more rugged and wears off more slowly. Moreover, this arrangement also corresponds to the structure of the conventional wheel arrangements for inline skates, so that a retrofit of conventional inline skates by the wheel arrangements according to the invention is possible without any problems.

A simple installation of the wheel arrangement is moreover ensured by the two-piece design of the internal hub and of the external hub. The installation is further simplified in that due to the two hub portions, which are not radially-symmetrical (in the present case the two internal hub halves), there is only one possibility to attach the two hub portions and thus the entire arrangement at the inline skate. An incorrect installation of the wheel arrangement at the inline skate, in particular by amateurs, is therefore excluded.

According to an advantageous development, a running wheel having a wheel body and a rim fixedly connected thereto is used. By attaching the rim at the bearing means it is possible to form the bearing between the running wheel and the external hub in a simple manner.

Advantageously, the rim may comprise a web having holes, said web extending in the radial direction. The wheel body may then be cast around the web and the holes. This ensures a stable attachment of the wheel body at the rim.

Purposefully, the rim is rotatably supported at the external hub by means of a ball bearing or a roller bearing. Bearings of this type are especially reliable and inexpensive bearing means.

Advantageously, the rim may be secured at the ball bearing or the roller bearing by means of a safety ring. Since such a safety ring can be easily attached and released, a simple installation is also ensured by this measure. This may enable an exchange of individual components, e.g. of the bearing means.

BRIEF DESCRIPTION OF THE DRAWINGS

Further advantages of the invention can be derived from the following detailed description of a preferred embodiment of the invention with reference to the drawings.

DETAILED DESCRIPTION OF PREFERRED EMBODIMENTS OF THE INVENTION

Figure 1:
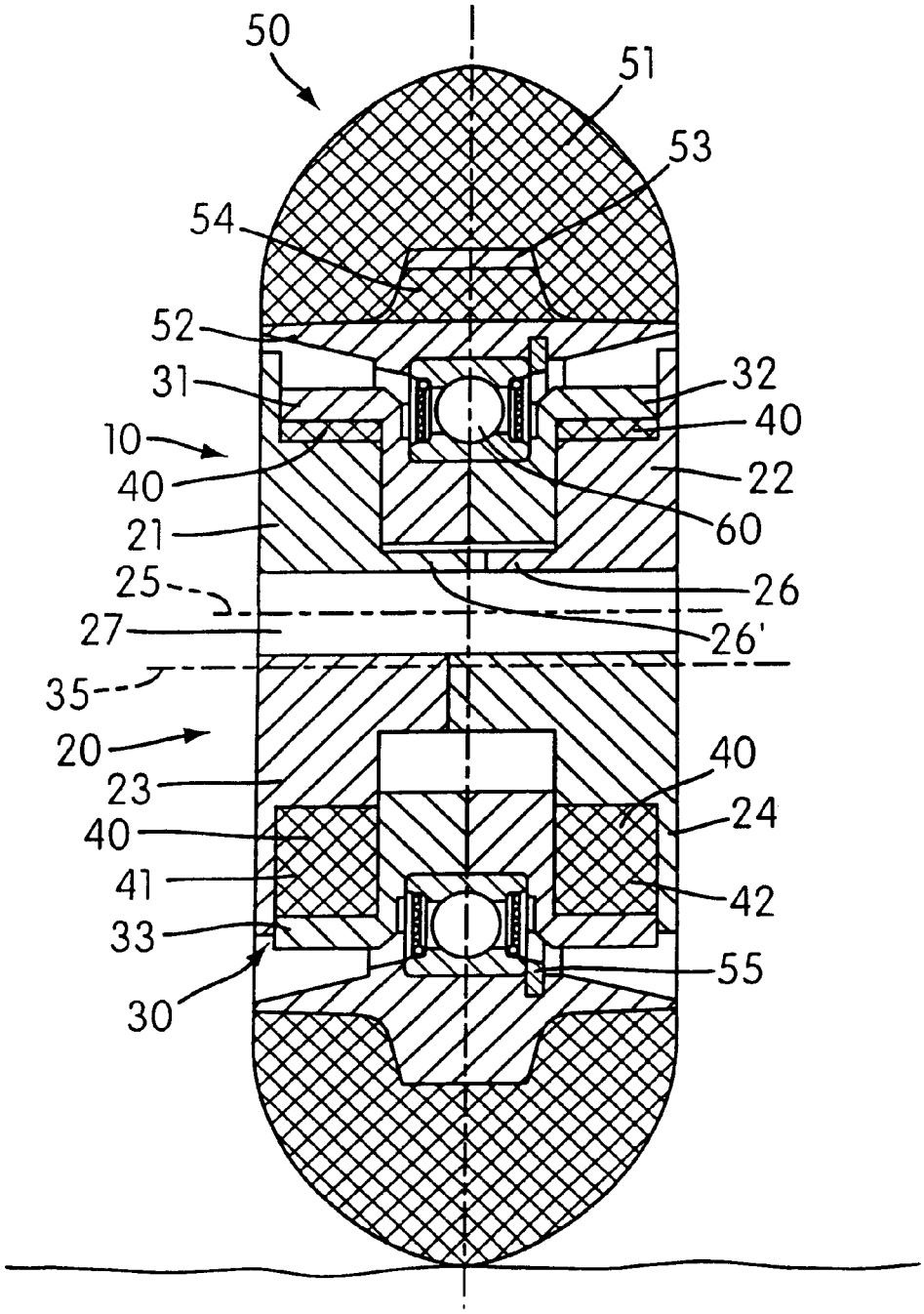
FIG. 1 shows a cross section of a wheel arrangement according to the present invention.

This wheel arrangement comprises a hub means 10 and a running wheel 50, which is rotatably supported on the hub means 10.

The hub means according to the embodiment shown comprises an internal hub 20 and an external hub 30. The internal hub as well as the external hub 30 in turn consist of two halves each, i.e. of two internal hub halves 21 and 22 and two external hub halves 31 and 32.

A spring element in the form of an elastic body 41*a,b* is provided between the first internal hub half 21 and the first external hub half 31. Similarly, a spring element [42] is arranged between the second internal hub half 22 and the second external hub half 32.

Figure 2:
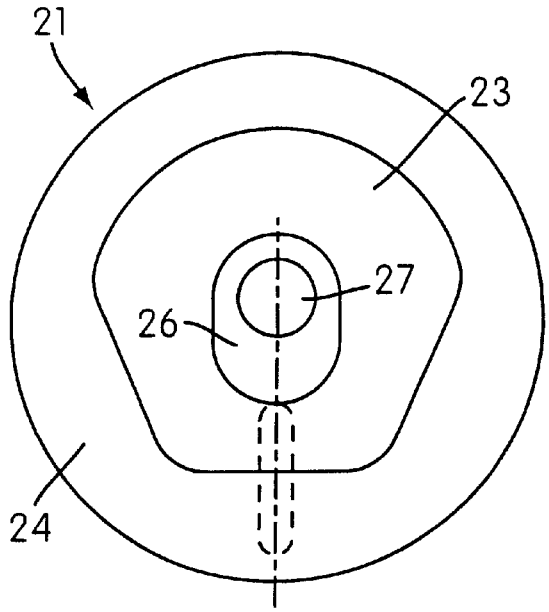
FIG. 2 shows a plan view onto a half of an internal hub of the wheel arrangement according to FIG. 1.
Figure 3:
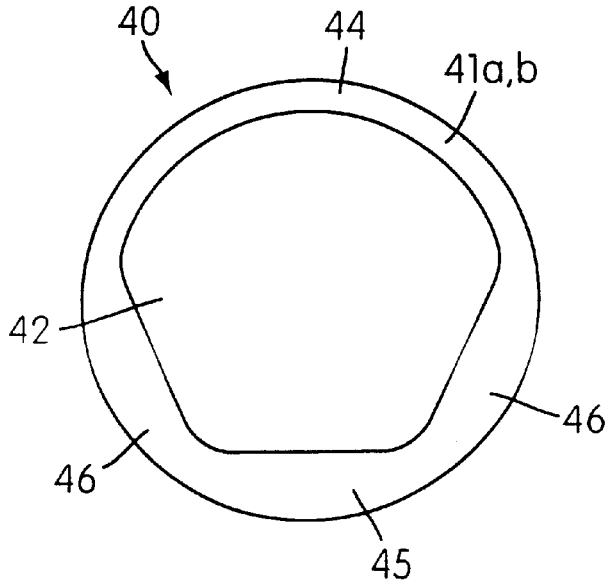
FIG. 3 shows a plan view onto a spring body of the wheel arrangement according to FIG. 1.

In FIG. 2 and 3, to which reference will now be made, a plane view onto the internal hub half 21 and a plane view onto the spring element 41 is shown.

As may be seen in FIG. 3, the spring element consists of an elastic body 41*a,b* which comprises an opening 42.

The internal hub half 21 shown in FIG. 2 in plane view comprises a circular and plate-shaped section 24. A section 23 is connected to this circular and plate-shaped section 24, the section 23 has a shape that corresponds to the opening 42 in the elastic body 41*a,b*. In particular, the section 23 of the internal hub 21 and the opening 42 of the elastic body 41 are formed in a manner that the section 23 interlockingly engages into the opening 42. A further appendix 26 shaped as a claw is connected to the section 23 of the internal hub half 21 as may be seen in FIG. 1. The appendix 26 are provided in a manner that when the wheel arrangement is installed, the appendix 26 is in fixed engagement with a claw 26' of the second internal hub half 22. A bore 27 extends through the section 26, wherein an axle having an axis 25 for attaching the wheel arrangement to the inline skate can be passed through the bore.

The internal hub half 21, which interlockingly engages into the opening 42 of the elastic body 41 is together with the elastic body 41, as shown in FIG. 1, accommodated in a corresponding cylindrical section 33 of the external hub half.

By the special design of the opening 42 in the spring element 41 and the section 23 of the internal hub halves 21 and 22*a* substantially fixed arrangement of the external hub with respect to the internal hub 21 is ensured. When installing the wheel arrangement in the inline skates, the external hub arrangement 30 is also fixed for co-rotation with respect to the inline state so that the running wheel 50 is freely rotatable by means of a bearing means 60 with respect to the inline skate.

It immediately follows from the fact that the external hub means 30 must be basically fixed for co-rotation with respect to the internal hub means 20 (and the inline skate fixedly connected therewith) in what manner the engagement section 23 of the internal hub half 21 and the corresponding opening 42 of the elastic body 41*a,b* must be formed. With respect to the elastic body 41*a,b*, the shape of the opening 42 should therefore significantly deviate from a radial symmetry. Accordingly, circular openings used as openings 42, whose center is close to the center of the totally circular elastic element, are not suitable.

As can moreover be seen from FIG. 1, the internal hub section 21 and 22 are designed in a manner that they comprise a guide section for the two external hub halves 31 and 32. This guide section is designed in a manner that a guide of the external hub means 30 in the internal hub means 20 is possible in the vertical direction in FIG. 1. Due to the spring element 41 and 42, this movement is, however, not free but possible in a damped manner only. Consequently, shocks, that are exerted onto the wheel arrangement in the vertical direction can be absorbed by the spring element 40. The power of absorbing and the spring path can be predetermined on the one hand by the material used for the spring element 40 and on the other hand by the shape of the opening 42 in the spring element 40.

The eccentric shape of the opening 42 of the spring element 41 results in that the axis 35 of the external hub means, i.e. the axis of rotation of the running wheel, is offset with respect to the axis of attachment 25.

[Hereby] Therefore, it is possible to install the entire wheel arrangement downwardly offset with respect to the attachment axis. Thus, a conventional wheel arrangement, in which only a small space is provided in the direction towards the inline skate between the wheel body and the inline skate, can be replaced by the wheel arrangement according to the invention, although it requires a larger installation clearance due to the spring path.

The eccentric, unsymmetrical shape of the opening 42 in the spring element 40 further leads to the fact that the spring element 40 has a broad section 45 and a narrow section 44. The wheel arrangement is attached at the inline skate in a manner that the narrow section 44 points towards the inline skate, whereas the broad section 45 points away from the inline skate. The spring path may then be enlarged at an equal size of the wheel arrangement.

Furthermore, the spring element 40 comprises lateral sections 46, which are also formed thicker than the section 44. These sections ensure that not only shocks are absorbed which are exerted perpendicularly from below onto the wheel arrangement installed in an inline skate, but also shocks that are exerted onto the wheel arrangement at an angle with respect to the vertical are absorbed.

The two external hub halves 31 and 32 are designed in a manner that they may receive a ball bearing. By means of this ball bearing, the running wheel 50 is supported rotatably on the external hub means 30.

The running wheel 50 is purposefully formed of a wheel body 51 and of a rim 52.

According to the embodiment shown in FIG. 1, the rim 52 comprises a web 53, which is provided with holes, one of which is shown in FIG. 1 and is provided with reference numeral 54. The wheel body 51 is cast around the web and through the holes. This ensures a fixed connection between the wheel body and the rim.

The rim 51 in turn is provided with a recess for accommodating the ball bearing 60. Purposefully, the bearing is secured at the rim by means of a safety ring 55. Therefore, the components of the wheel arrangement can be easily mounted and dismounted.

Instead of the ball bearing shown in FIG. 1, other bearing means, such as roller bearings or needle bearings, can of course also be used.

What is claimed is:

1. A running wheel arrangement, comprising:

a hub means, and a running wheel which is rotatably supported on the hub means;

wherein the hub means comprises an internal hub and an external hub, which are arranged radially displaceable with respect to one another but fixed for co-rotation, and a spring means which is provided between the internal hub and the external hub; and the axis of the external hub and the attachment axis of the internal hub are parallel and offset with respect to one another.

2. A running wheel arrangement as claimed in claim 1, wherein the external hub is provided slidably in a radial direction within the internal hub.

3. A running wheel arrangement as claimed in claim 1 or 2, wherein the spring means is provided in the form of an elastic body made of PU foam.

4. A running wheel arrangement as claimed in claim 3, wherein the elastic body has an opening.

5. A running wheel arrangement as claimed in claim 4, wherein the internal hub comprises a section for the interlocking engagement into the opening of the elastic body, and the external hub comprises a section for the interlocking accommodation of the elastic body wherein both sections are designed in a manner that through the inserted elastic body the substantially fixed arrangement of the internal hub with respect to the external hub is realized.

6. A running wheel arrangement as claimed in claim 4, wherein the external hub comprises a section for the interlocking engagement into the opening of the elastic body, and the internal hub comprises a section for the interlocking accommodation of the elastic body, wherein both sections are formed in a manner that by the inserted elastic body the substantially fixed arrangement of the internal hub with respect to the external hub is realized.

7. A running wheel arrangement as claimed in claim 1, wherein the internal hub comprises two halves which can be plugged into one another in the axial direction in a manner that they are fixed for co-rotation.

8. A running wheel arrangement as claimed in claim 7, wherein the halves comprise claws for forming a fixed coupling of the two halves.

9. A running wheel arrangement as claimed in claim 1, wherein the external hub comprises two halves.

10. A running wheel arrangement as claimed in claim 9, wherein the internal hub comprises two halves which can be plugged into one another in the axial direction in a manner that they are fixed for co-rotation, and wherein the spring means comprises a first spring element and a second spring element, the first spring element is provided between one half of the internal hub and one half of the external hub and the second spring element is provided between the other half of the internal hub and the other half of the external hub.

11. A running wheel arrangement as claimed in claim 9, wherein the halves comprise claws for forming a fixed coupling of the two halves, and wherein the spring means comprises a first spring element and a second spring element, the first spring element is provided between one half of the internal hub and one half of the external hub and the second spring element is provided between the other half of the internal hub and the other half of the external hub.

12. A running wheel arrangement as claimed in claim 1, wherein the running wheel comprises a wheel body and a rim fixedly connected therewith.

13. A running wheel arrangement as claimed in claim 12, wherein the rim comprises a web with holes extending in the radial direction, and the wheel body is cast around the web and the holes.

14. A running wheel arrangement as claimed in claim 12 or 13, wherein the rim is rotatably supported on the external hub by means of a ball bearing or a roller bearing.

15. A running wheel arrangement as claimed in claim 12, wherein the rim is secured at the ball bearing or roller bearing by means of a safety ring.

16. A running wheel arrangement as claimed in claim 13, wherein the rim is secured at the ball bearing or roller bearing by means of a safety ring.

17. A running wheel arrangement as claimed in claim 14, wherein the rim is secured at the ball bearing or roller bearing by means of a safety ring.

* * * * *